US011486628B2

(12) United States Patent
Aoki et al.

(10) Patent No.: US 11,486,628 B2
(45) Date of Patent: Nov. 1, 2022

(54) REFRIGERATOR

(71) Applicant: Samsung Electronics Co., Ltd., Suwon-si (KR)

(72) Inventors: Ryota Aoki, Yokohama (JP); Kenji Takeuchi, Yokohama (JP); Toshimitsu Tsuruga, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 437 days.

(21) Appl. No.: 16/499,844

(22) PCT Filed: Mar. 29, 2018

(86) PCT No.: PCT/JP2018/013497
§ 371 (c)(1),
(2) Date: Sep. 30, 2019

(87) PCT Pub. No.: WO2018/181835
PCT Pub. Date: Oct. 4, 2018

(65) Prior Publication Data

US 2020/0103161 A1 Apr. 2, 2020

(30) Foreign Application Priority Data

Mar. 30, 2017 (JP) ..... JP2017-068119
Dec. 20, 2017 (JP) ..... JP2017-243995

(51) Int. Cl.
*F25D 21/04* (2006.01)
*F25D 23/06* (2006.01)
*F25D 23/00* (2006.01)

(52) U.S. Cl.
CPC ..... *F25D 23/068* (2013.01); *F25D 21/04* (2013.01); *F25D 23/006* (2013.01);
(Continued)

(58) Field of Classification Search
CPC ..... F25D 21/04; F25D 23/068; F25D 3/006; F25D 3/067
See application file for complete search history.

(56) References Cited

U.S. PATENT DOCUMENTS

2013/0037240 A1* 2/2013 Jeon ..... F25D 21/04 165/104.21
2016/0298291 A1* 10/2016 Yoshida ..... D06N 3/0068

FOREIGN PATENT DOCUMENTS

JP S61-235670 A 10/1986
JP S63-65272 A 3/1988
(Continued)

OTHER PUBLICATIONS

ISA/JP, International Search Report and Written Opinion of the International Searching Authority, International Application No. PCT/JP2018/013497, dated Jun. 19, 2018, 16 pages.

*Primary Examiner* — Brian M King

(57) ABSTRACT

A refrigerator 10 comprises at least one box-shaped storage compartment 14 and a heat radiating member 23. The storage compartment 14 is formed in such a way that one side of a frame formed by a wall member is closed and the other thereof is provided with an opening surface configured to be opened or closed by a door. The wall member includes a hollow structure composed of a plurality of plate members 21 and 22 and a foam insulation 25 filled in the hollow structure. The heat radiating member 23 is arranged in the wall member. In the wall member, a pressure member 24 configured to press the heat radiating member against the plate member is provided. The pressure member 24 is a material configured to press the heat radiating member 23 under predetermined conditions.

14 Claims, 8 Drawing Sheets

(52) U.S. Cl.
CPC ..... *F25D 23/061* (2013.01); *F25D 23/067* (2013.01); *F25D 2201/126* (2013.01)

(56) References Cited

FOREIGN PATENT DOCUMENTS

| | | | |
|---|---|---|---|
| JP | S63-163758 | A | 7/1988 |
| JP | H11-201373 | A | 7/1999 |
| JP | 2004-225946 | A | 8/2004 |
| JP | 2009-068777 | A | 4/2009 |

* cited by examiner

REFRIGERATOR

CROSS-REFERENCE TO RELATED APPLICATIONS

This application is a 371 National Stage of International Application No. PCT/JP2018/013497, filed Mar. 29, 2018, which claims priority to Japan Patent Application No. 2017-068119, filed Mar. 30, 2017, and Japan Patent Application No. 2017-243995, filed Dec. 20, 2017, the disclosures of which are herein incorporated by reference in their entirety.

BACKGROUND

1. Field

The present disclosure relates to a refrigerator.

2. Description of Related Art

A refrigerator includes a body and a door for closing an opening of the body. A storage compartment for storing food is provided inside the body. The body may be divided into a plurality of storage compartments such as a refrigerating compartment and a freezing compartment by an insulating partition. The door may include a hinge type door or a drawer type door Around the opening that is closed by the door, dew condensation is likely to occur due to cold air from the inside of the refrigerator. To prevent dew condensation, a heat radiating member (for example, a refrigerant pipe in which a high temperature refrigerant flows) is installed in a body wall in vicinity of the opening or in the inside of the insulating partition.

In order to fix the heat radiating member, a method in which a flexible member is arranged on a rear surface of the heat radiating member to press the heat radiating member against a front plate is well known (patent document 1).

Patent Document

Patent Document 1: Japanese Patent Application Laid-Open No. 2015-034680.

SUMMARY

As described above, in a refrigerator in which the heat radiating member is arranged around the opening, dew condensation prevention is not stably performed and variation easily occurs. Therefore, in order to stably prevent the dew condensation, it is required to flow a high temperature refrigerant with a tolerance, which leads to difficulties such as the increase in the power consumption caused by the increase of the thermal leakage.

The present disclosure is directed to providing a refrigerator capable of more stably preventing dew condensation.

As described above, the inventor of the present disclosure pays attention to a positional relationship between a front plate of a wall of a body or a front plate of an insulating partition, and a heat radiating member.

A body of the refrigerator is formed in such a way that a foam insulation is filled between an inner case and an outer case formed by a thin plate. A heat radiating member is arranged between the outer case and the inner case in the vicinity of the front plate around the opening. In the process of filling the foam insulation, a deviation is likely to occur in the amount of foaming and thus a deviation is also likely occur in the installation position of the heat radiating member. Even when a flexible member is used, as disclosed in patent document 1, a force for pressing the heat radiating member is insufficient, and thus the deviation still occurs in the position of the heat radiating member. Due to this imbalance, the dew condensation prevention effect using the heat radiating member is not stable. In view of this, the present inventors intend to stably prevent dew condensation by stabilizing the installation position of the heat radiating member.

One aspect of the present disclosure provides a refrigerator including at least one box-shaped storage compartment and a heat radiating member. The storage compartment is formed in such a way that one side of a frame formed by a wall member is closed and the other thereof is provided with an opening surface configured to be opened or closed by a door. The wall member includes a hollow structure composed of a plurality of plate members and a foam insulation filled in the hollow structure. The heat radiating member is arranged in the wall member. In the wall member, a pressure member configured to press the heat radiating member against the plate member is provided. The pressure member is a material configured to obtain a state of pressing the heat radiating member against the plate member under predetermined conditions.

It is possible to press a heat radiating member to a desired position in a wall member of a storage compartment by allowing the pressure member to be in a predetermined condition according to the foam insulation. Therefore, because the position of the heat radiating member is stabilized, it is possible to more stably prevent dew condensation

DETAILED DESCRIPTION

First Embodiment

Figure 1:
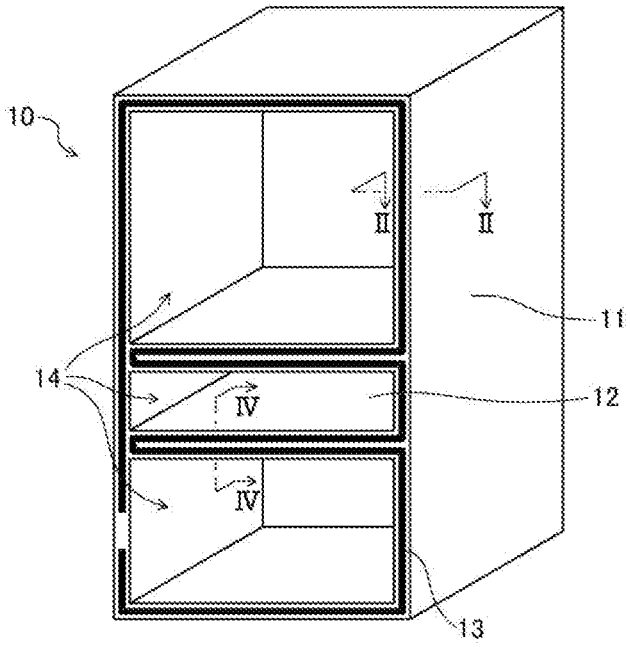
FIG. 1 is a view schematically illustrating a refrigerator according to one embodiment of the present disclosure.

A refrigerator according to a first embodiment of the present disclosure will be described with reference to the drawings. FIG. 1 is a perspective view illustrating an example of a refrigerator 10 according to the first embodiment.

The refrigerator 10 includes a body 11 and an insulating partition 12 configured to divide the inside of the body 11 into a plurality of storage compartments 14. The storage compartment 14 is formed in a box shape. Particularly, between two openings, which are formed on a rectangular frame formed of a wall member, one side (inside in FIG. 1)

is closed by other wall and the other (outside in FIG. 1) is provided as an opening surface to allow foods to be inserted thereinto or taken out therefrom. Although not shown, the opening surface may be closed by a door. The door may include a hinge door or a drawer door.

As for the refrigerator including a plurality of storage compartments 14 as illustrated in FIG. 1, each storage compartment 14 is formed by a portion of the body 11 and the insulating partition 12 corresponding to a wall member. The plurality of storage compartments may include a refrigerating compartment maintained at about +5 to −3° C., and a freezing compartment maintained at about −10 to −30° C. Alternatively, the refrigerator may have a single storage compartment and in this case, the storage compartment 14 may be formed by a portion of the body 11 corresponding to a wall member.

As a means for cooling the storage chamber 14, a cooling cycle is used. The refrigeration cycle is composed of a compressor, a condenser, an evaporator, a capillary tube, a dryer, and an accumulator, which are combined by piping to form a refrigeration cycle in which refrigerant is circulated.

The refrigerator 10 includes a heat radiating member 13 around the opening surface of the storage compartment 14. The heat radiating member 13 is embedded in the wall member, and located on an edge portion of the wall member in the opening surface side. For example, a refrigerant pipe or a cord heater may be used as the heat radiating member 13, and the refrigerant pipe is configured to radiate heat as the high temperature refrigerant of the refrigerating cycle flows and the cord heater is configured to generate heat by applying a current.

Accordingly, dew condensation around the opening surface may be prevented. That is, although dew condensation is likely to occur around the opening surface of the storage compartment 14 because ambient air is cooled by the low temperature from the storage chamber 14, it is possible to prevent the vicinity of the opening surface of the storage compartment 14 from being cooled because the heat radiating member 13 radiates heat. Therefore, it is possible to prevent the dew condensation.

Figure 2:
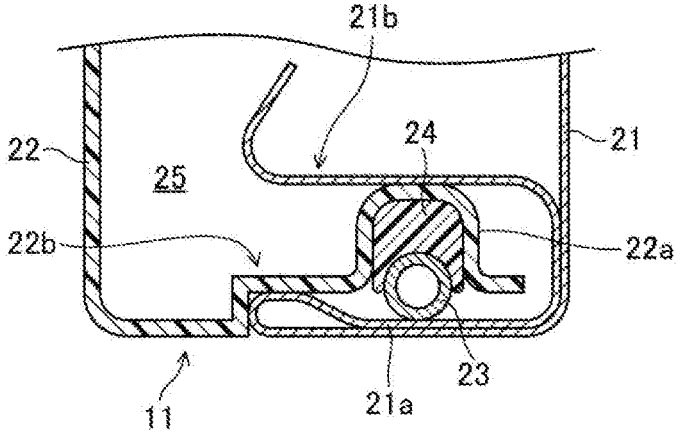
FIG. 2 is a view schematically illustrating a cross section taken along a line II-II of FIG. 1.

Next, an example of installing the heat radiating member 13 in a wall member will be described. FIG. 2 is a cross section taken along a line II-II of the body 11 of the refrigerator 10, that is a cross sectional view illustrating a vicinity of an end portion of the outer wall in the opening surface side.

The body 11 includes an outer case 21 formed of a metallic plate member, an inner case 22 formed of a resinous plate member, and a foam insulation 25 filled therebetween. The plate member forming the outer case 21 is curved to form an end surface member 21*a* of the opening surface side (lower side in FIG. 2) while forming a support portion 21*b* formed in U-shape that is opened to the inside of the storage compartment 14 (left side in FIG. 2). Further, the inner case 22 is provided with a flange portion 22*b* extending to the outside in the end portion of the opening surface side. The flange portion 22*b* includes a heat radiating member support portion 22*a* inserted into the support portion 21*b* and opened to the opening surface side to support the refrigerant pipe 23.

For example, the refrigerant pipe 23 is a pipe formed of a material such as copper or iron, and functions as a heat radiating member by allowing a high temperature refrigerant of a refrigeration cycle therein to flow.

The refrigerant pipe 23 is arranged in the heat radiating member support portion 22*a* of the flange portion 22*b* and is pressed against the end surface member 21*a* by a pressure member 24. Therefore, the refrigerant pipe 23 is stably arranged at a position that is pressed by the end surface member 21*a*. Accordingly, the dew condensation prevention effect by the refrigerant pipe 23 is stable, and the necessity of allowing a high temperature refrigerant to flow with an effective tolerance in the refrigerant pipe 23 is reduced. That is, it is possible to lower the temperature of the refrigerant flowing in the refrigerant pipe 23, thereby reducing the amount of heat leakage from the refrigerant pipe 23 into the storage compartment 14, and improving the efficiency of the refrigeration cycle.

The body 11 is formed in such a way that the foam insulation 25 is filled in between the outer case 21 and the inner case 22, and then the foam insulation 25 foams. The foam insulation 25 is a material that generates heat during foaming such as rigid urethane foam. For example, when the foam insulation 25 foams, a temperature thereof rises up to about 60~120° C. due to the heat generation.

In addition, the pressure member 24 is formed of a thermally expandable material that expands upon receiving heat. For example, the thermally expandable material contains a material that foams at a predetermined temperature, and the predetermined temperature is a temperature obtained by heat when the foam insulation 25 foams. Therefore, it is possible to expand the pressure member 24 using the heat generated when the foam insulation 25 foams.

Figure 3:
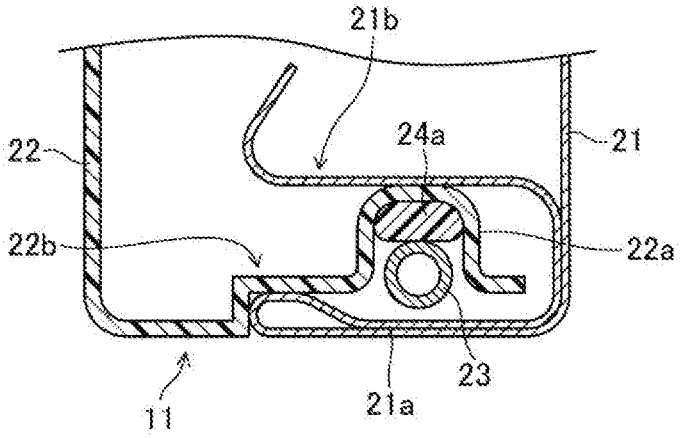
FIG. 3 is a view illustrating a manufacturing process for obtaining a structure of FIG. 2.

In this regard, FIG. 3 shows a state before the foam insulation 25 is filled and foams. In FIG. 3, a pressure member 24*a*, which is in a state before expansion, and the refrigerant pipe 23 are arranged in the heat radiating member support 22*a*, and the flange portion 22*b* of the inner case 22 is inserted into the support portion 21*b* of the outer case 21. Because the pressure member 24*a* before expansion has a smaller volume than the pressure member 24 after expansion, the pressure member 24*a* before expansion does not have a force for pressing the refrigerant pipe 23 against the end surface member 21*a*. Therefore, the refrigerant pipe 23 is spaced apart from the end surface member 21*a*.

In this state, when the foam insulation 25 is filled and foams in a gap between the inner case 22 and the outer case 21, the pressure member 24*a* before expansion expands due to the heat generation of the foam insulation 25. As a result, the refrigerant pipe 23 is pressed against the end surface member 21*a* by the pressure member 24, which is illustrated in FIG. 2.

As mentioned above, in the refrigerator 10 according to the first embodiment, it is not necessary to perform a separate process for thermally expanding the pressure member 24, and thus it is possible to manufacture a refrigerator by suppressing the increase in the number of manufacturing processes, and the increase in manufacturing cost.

In addition, by using a material having strong repulsion as the pressure member 24, it is possible to reliably press the refrigerant pipe 23 against the end surface member 21*a*. However, in this case, it is needed to assemble the body 11 while pressing the refrigerant pipe 23 against the repulsive force of the pressure member 24. This leads to the increase in the difficulty of manufacturing refrigerators, and the increase in the number of processes and costs. On the other hand, when applying the structure of this embodiment, the refrigerator may be easily assembled.

A thermally expandable material is a material formed in such a way that a powdery material, in which foaming agents are filled in a hollow of a particle formed of thermoplastic resins, is mixed with a liquid or a gel. Alternatively, the thermally expandable material may be formed by distributing the powdery material to a solid material.

Such a thermally expandable material is thermally expanded as the powdery material foams at a predetermined temperature. The predetermined temperature at which thermal expansion occurs may be set according to the hollow particles and the foaming agent, and the predetermined temperature may correspond to a temperature that is reached upon the foaming of the foam insulation 25 (about 60 to 120° C. in the above example).

For example, an outer diameter of the hollow particles constituting the powdery material is 5 to 200 μm before expansion, and when the outer diameter increases by from approximately 2 to 5 times due to the heat, the volume of the thermally expandable material increases by from approximately 10 to 100 times.

For example, as the thermoplastic resin constituting the hollow particles, polymethyl methacrylate (PMMA), or polyvinylidene chloride (PVDC) may be used. For example, aliphatic hydrocarbons may be mainly used as the foaming agent.

As a gel for mixing the powdery material, an organic gel which does not contain water may be used. Similarly, as a liquid for mixing the powdery material, an organic solvent which does not contain water may be used. Further, as a solid material on which the powdery material is distributed, PVC or a rubber type material may be used.

Alternatively, instead of the powdery material containing the foaming agent described above, a material such as a resin having a shape memory performance may be used as the pressure member 24. That is, the shape memory material capable of memorizing a state in which a volume is large is provided, and then the shape memory material having a small volume is arranged in the heat radiating member support portion 22*a*. When the shape memory material is deformed into the memorized state in which the volume is large, by the heat upon the foaming of the foam insulation 25, the force for pressing the refrigerant pipe 23 against the end surface member 21*a* is applied. A temperature, at which the shape memory material is deformed into the memorized state, may be selected according to the type of material. In the example of this embodiment, because the foaming temperature of the foam insulation 25 about is 60-120° C., a shape memory material capable of recovering a shape at such temperature may be used as the foam insulation 25. Depending on the type of shape memory material, deformation of 400 to 500% is possible.

In addition, the pressure member 24 after expansion may have a thermal conductivity lower than that of the surrounding member forming the wall member, particularly, the plate member of the inner case 22 and the outer case 21. Therefore, it is possible to suppress the heat conduction through the pressure member 24, and thus it may contribute to the heat insulation improvement of the body 11.

In addition, according to the first embodiment, the pressure member 24*a* before expansion, which has a shape different from the refrigerant pipe 23, is changed into the pressure member 24 which has a shape corresponding to the shape of the refrigerant pipe 23 while expanding, as illustrated in FIG. 3. Therefore, the pressure member 24 is in contact with the refrigerant pipe 23 in a plane (a line in the cross sectional view), which is appropriate for the purpose of fixing the refrigerant pipe 23, but it is not required. For example, a lower side of the pressure member 24*a* before expansion illustrated in FIG. 3 may expand in an approximately flat shape, and thus the pressure member and the heat radiating member may be in contact with each other in an approximately linear shape (a dot in the cross section). In this case, the function of pressing the heat radiating member against the end surface member 21*a* is realized In addition, when the pressure member 24 is deformed to correspond to the outer shape of the refrigerant pipe 23, it is possible to fix the refrigerant pipe 23 by using the pressure member 24 without another member for selecting a position of the refrigerant pipe 23.

(Application for Insulation Partition)

Figure 4:
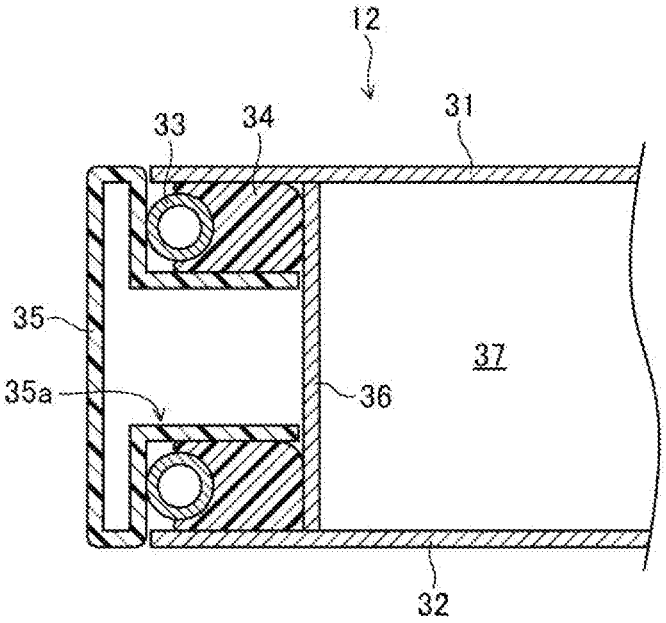
FIG. 4 is a view schematically illustrating a cross section taken along a line IV-IV of FIG. 1.

Next, another example of the arrangement method of the heat radiating member 13 in the wall member will be described. FIG. 4 is a cross-sectional view taken along a line IV-IV in the refrigerator 10, that is, a cross-sectional view of an end portion of the insulating partition 12, which is configured to partition the storage compartments 14 of the refrigerator 10, in the opening surface side.

The insulating partition 12 includes a plate member 31 and a plate member 32, and a foam insulation 37 filled in between the plate member 31 and the plate member 32. Further, in the opening surface side (left side in FIG. 4), as well as an end surface member 35, a heat radiating member support portion 36 configured to connect two plate members 31 and 32 to each other is provided. The end surface member 35 has an end surface shape having an insertion portion 35*a* inserted into between the plate member 31 and the plate member 32. On opposite sides in the vertical direction in the vicinity of the end surface inside the insulating partition 12, a space, in which a refrigerant pipe 33 corresponding to a heat radiating member is placed, is formed by the insertion portion 35*a* of the end surface member 35, the heat radiating member support portion 36, and a portion of the plate member 31 and the plate member 32. In the space, a pressure member 34 is arranged between the refrigerant pipe 33 and the pipe support portion 36. The pressure member 34 generates a force for pressing the refrigerant pipe 33 against the end surface member 35. In addition, although not shown in FIG. 4, a means for fixing the end surface member 35 so as not to fall off due to the force from the pressure member 34 is used. For example, a latch formed by extending the insertion portion 35*a* may be caught by the heat radiating member support portion 36 in several places.

As for the insulating partition 12, the pressure member 34 is formed of a thermally expandable material which receives heat and expands. In addition, such thermal expansion is caused by heat generated when the foam insulation 37 is filled and foams. That is, in the insulating partition 12, the pressure member 24 before expansion is arranged between the pipe support portion 36 and the refrigerant pipe 33, and the pressure member 34 expands upon the foaming of the foam insulation 37, which is a configuration of FIG. 4. In this process, a separate process for expanding the pressure member 34 is not required.

Because the pressure member 34 press the refrigerant pipe 33 against the end surface member 35 side, a position of the refrigerant pipe 33 is stable. Therefore, the dew condensation prevention effect by the refrigerant pipe 33 is stable, and the necessity of allowing a high temperature refrigerant to flow with an effective tolerance in the refrigerant pipe 33 is reduced. That is, it is possible to lower the temperature of the refrigerant flowing in the refrigerant pipe 33, thereby reducing the amount of heat leakage from the refrigerant pipe 33 into the storage compartment 14 and improving the efficiency of the refrigeration cycle.

In addition, in the above, the case where the thermally expandable material that expands by heat is used as a pressure member has been illustrated. However, the pressure member may expand under other conditions. For example, the pressure member may expand by applying a predetermined pressure, acceleration, or vibration, or by satisfying the pressure member a predetermined pH or by making a predetermined chemical reaction. Even in this case, the pressure member may press the refrigerant pipe 33 against the end surface member and thus the refrigerant pipe 33 may be placed in a stable position.

(Modification)

Hereinbefore the case of using a thermally expandable material as the pressure member 24 and the case of using a shape memory material as the thermally expandable material have been described. However, it is possible to press the refrigerant pipe 23 against the end surface member 21*a* by deforming a material instead of expanding the material.

In this case, use of the shape memory material may be considered. That is, the shape memory material, which memorizes a shape capable of pressing the refrigerant pipe 23, is provided, and the shape memory material is deformed as a shape that does not apply a force to the refrigerant pipe 23, and then the shape memory material is arranged instead of the pressure member 24*a* before expansion illustrated in FIG. 3. For example, a pressure member having a wrinkles (bellows) shape or spring shape capable of memorizing an expanded state is provided and to compress the pressure member and then the compressed pressure member is arranged. The pressure member is deformed into the memorized shape by the heat generated when the foam insulation foams. When the pressure member having the wrinkles shape or the spring shape is used, the pressure member is deformed into an expanded state. Accordingly, the pressure member may press the refrigerant pipe 23.

Second Embodiment

Next, a second embodiment of the disclosure will be described. Because the refrigerator of this embodiment has the same basic structure as the refrigerator 10 according to the first embodiment illustrated in FIG. 1, a difference will be mainly described below.

Figure 5:
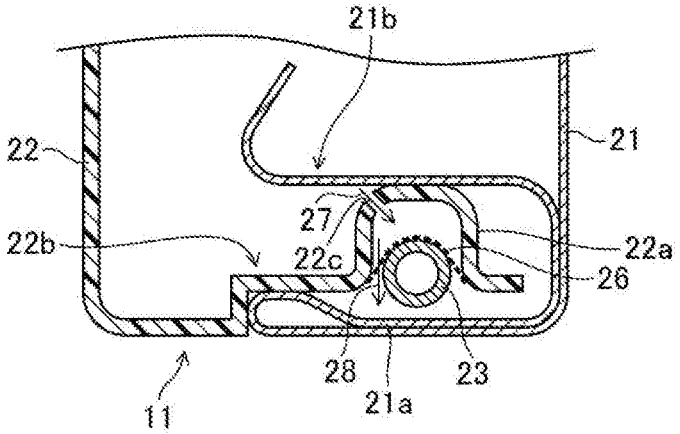
FIG. 5 is a view schematically illustrating a cross section taken along a line II-II of FIG. 1 according to another embodiment of the present disclosure.

FIG. 5 is a view schematically illustrating a cross section of the body 11 taken along a line II-II of FIG. 1 in a refrigerator according to the second embodiment of the present disclosure. According to the embodiment, a body 11 includes an outer case 21, an inner case 22, and a foam insulation 25, which is in the same manner as the first embodiment. Further, the second embodiment is the same as the first embodiment in that an end surface member 21*a* and a support portion 21*b* are formed by the plate member forming the outer case 21, and a flange portion 22*b* and a heat radiating member support portion 22*a* are formed by the plate member forming the inner case 22. Further, a refrigerant pipe 23 corresponding to a heat radiating member is arranged in the heat radiating member support portion 22*a*.

As for the refrigerator according to the second embodiment, a gas permeable film 26 configured to transmit gas and configured to block the foam insulation 25 is arranged so that the refrigerant pipe 23 is arranged between the end surface member 21*a* and the gas permeable film 26. The gas permeable film 26 functions as a pressure member in this embodiment. Further, a through hole 22*c* is provided in the heat radiating member support portion 22*a*.

When the foam insulation 25 is filled between the outer case 21 and the inner case 22, the foam insulation 25 passes through the through hole 22*c* and then is filled in the heat radiating member support portion 22*a* (indicated by an arrow 27) because the through hole 22*c* is provided. As mentioned above, the gas permeable film 26 transmits gas but blocks the foam insulation 25. Therefore, when the foam insulation 25 is filled and foams in the heat radiating member support portion 22*a*, the gas permeable film 26 moves due to the pressure, and the foam insulation 25 corresponding to the pressure member press the refrigerant pipe 23 against the end surface member 21*a*.

At this time, the gas such as air may pass through the gas permeable film 26 as shown by an arrow 28 and then escaped from the heat radiating member support portion 22*a*. Therefore, the refrigerant pipe 23 is stably arranged at the position pressed by the end surface member 21*a*. In addition, the refrigerant pipe 23 is illustrated in the position slightly away from the end surface member 21*a* in FIG. 5, which illustrates a state before the foam insulation 25 is filled and the refrigerant pipe 23 is pressed by the end surface member 21*a*.

Third Embodiment

Next, a third embodiment of the present disclosure will be described. Because the refrigerator of this embodiment has the same basic structure as the refrigerator 10 according to the first embodiment illustrated in FIG. 1, a difference will be mainly described below.

Figure 6:
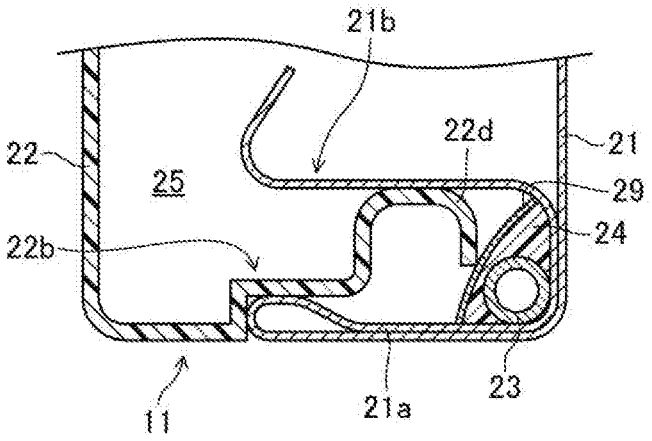
FIG. 6 is a view schematically illustrating a cross section taken along a line II-II of FIG. 1 according to still another embodiment of the present disclosure.

FIG. 6 is a view schematically illustrating a cross section of the body 11 taken along a line II-II of FIG. 1 in a refrigerator according to the third embodiment of the present disclosure. According to the third embodiment, a body 11 includes an outer case 21, an inner case 22, and a foam insulation 25, which is in the same manner as the first embodiment. Further, the third embodiment is the same as the first embodiment in that an end surface member 21*a* and a support portion 21*b* are formed by the plate member forming the outer case 21, and a flange portion 22*b* and a heat radiating member support portion 22*a* are formed by the plate member forming the inner case 22. However, in comparison with the heat radiating member support portion 22*a* of FIG. 1, the heat radiating member support portion 22*a* according to the third embodiment does not have a function of supporting the refrigerant pipe 23, but a fixer 22*d* configured to fix the flange portion 22*b* is provided in the support portion 21*b*.

According to the embodiment, the refrigerant pipe 23 is arranged at a position close to an outer corner of the body 11 while being biased toward the end surface member 21*a*. In addition, the pressure member 24 is arranged to cover the refrigerant pipe 23 and the pressure member 24 is covered with a cover member 29 such as an aluminum tape. The cover member 29 functions to arrange the refrigerant pipe 23 and the pressure member 24 at a predetermined position in the manufacturing process of the refrigerator 10.

In the refrigerator according to the embodiment, the refrigerant pipe 23 is fixed at a predetermined position by the pressure member 24 itself.

According to the embodiment, the refrigerant pipe 23 is pressed toward the outer care 21 by the pressure member 24. The pressure member 24 is formed of a thermally expandable material that receives heat and expands. In addition, such thermal expansion is caused by heat when the foam insulation 25 is filled and foams. It is not needed to perform the separate process for thermally expanding the pressure member 24.

Other Configuration Example

In the refrigerator 10 of FIG. 1, the heat radiating member 13 is arranged on opposite sides of the insulating partition 12 and the body 11 and thus all three storage compartments 14 are provided with the heat radiating member 13 all around the opening surface, but is not required. Therefore, the heat radiating member 13 may be omitted for the insulating partition 12. In addition, when using other dew condensation prevention means together, the heat radiating member 13 maybe arranged on only a part of peripheral portion of the opening surface.

Figure 7:
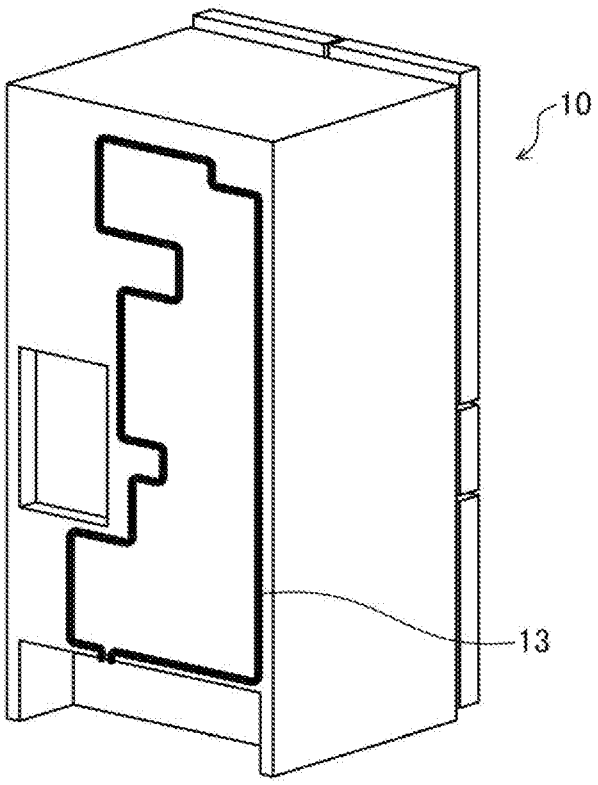
FIG. 7 is a view of a rear side of the refrigerator of FIG. 1, illustrating an embodiment in which a heat radiating member is arranged in the rear side.

In addition, in the above, the case in which the heat radiating member 13 is arranged along the end surface member 21*a* as illustrated FIG. 2 has been described. However, the heat radiating member 13 may be arranged at another position. For example, FIG. 7 illustrates an example in which the heat radiating member 13 is arranged on the back side of the refrigerator 10. That is, an inner wall of the storage compartment 14 (the opposite side of the door) also is formed of a wall member including a pair of plates and a foam insulation filled between the pair of plates, and the heat radiating member 13 is arranged in the wall member. Even in such a case, the heat radiating member 13 may be pressed against the outer case 21 by using the expansion of the pressure member 24. Similarly, the heat radiating member 13 may be arranged on the side of the refrigerator 10.

In addition, in the above, the case, in which the refrigerant pipe configured to radiate heat by allowing a high temperature refrigerant of the refrigeration cycle to flow is used as the heat radiating member, has been described. However, a cord heater configured to generate heat by applying a current may be used as the heat radiating member.

Figure 8:
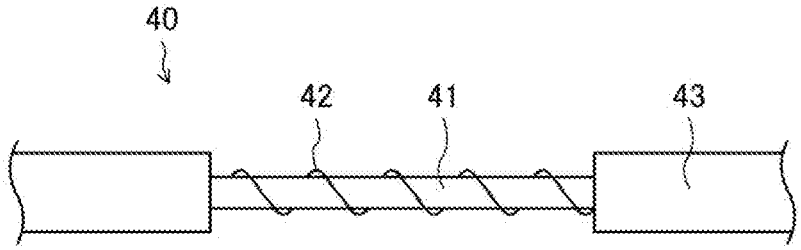
FIG. 8 is a view illustrating a cord heater as an example of a heat radiating member.

FIG. 8 illustrates an example of a cord heater. A cord heater 40 includes a core wire 41 formed of a glass wire or a resin wire, a heating wire 42 wound around the core wire 41, and a heat resistant coating 43 covering the core wire 41 and the heating wire 42. For example, the heat resistant coating 43 is formed of vinyl or silicon. Further, FIG. 8 illustrates that a portion of the heat resistant coating 43 is cut out and the core wire 41 and the heating wire 42 are exposed.

The cord heater is more flexible and has a higher degree of freedom in shape than refrigerant pipes, and thus it is easy to arrange the cord heater according to the described shape. The refrigerant pipe is a pipe formed of copper or iron and thus a process of bending the pipe and a process of connecting the pipe by welding are required so as not to be closed. However, the cord heater does not need those processing.

When the cord heater is used instead of the refrigerant pipe, it is not needed to arrange the refrigerant pipe around the front opening of the refrigerator for the purpose of preventing dew condensation. Therefore, it is possible to reduce the refrigerant pipe and to simplify the construction of the refrigeration cycle. Further, because it is possible to provide the refrigeration cycle only in the machine room of the refrigerator and to provide only electrical wiring to the storage compartment, it is possible to reduce the number of welding of the refrigerant pipe. Therefore, it is possible to reduce the manufacturing cost of the refrigerator.

In addition, because the refrigerant pipe is a component forming a part of the refrigeration cycle, it is difficult to finely adjust the temperature. On the other hand, the cord heater is configured to finely adjust the temperature by adjusting the amount of current to be applied, and when heat generation for dew condensation prevention is not required, it is possible to prevent the heat generation of the cord heater. Therefore, it is possible to reduce unnecessary heat intrusion into the inside of the refrigerator.

INDUSTRIAL APPLICABILITY

The refrigerator of the present disclosure is useful as a more efficient refrigerator because it can stably suppress dew condensation while suppressing the amount of heat generation.

DESCRIPTION OF SYMBOLS

10: refrigerator
11: body
12: insulating partition
13: heat radiating member
14: storage compartment
21: outer case
21*a*: end surface member
21*b*: support portion
22: inner case
22*a*: heat radiating member support portion
22*b*: flange portion
22*c*: through hole
22*d*: fixer
23: refrigerant pipe
24: pressure member
24*a*: pressure member before expansion
25: foam insulation
26: gas permeable film
29: cover member
31: plate member
32: plate member
33: refrigerant pipe
34: pressure member
35: end surface member
35*a*: insertion portion
36: heat radiating member support portion
37: foam insulation
40: cord heater
41: core wire
42: heating wire
43: heat resistant coating

The invention claimed is:

1. A refrigerator comprising:

an outer case;

an inner case arranged inside the outer case to define a storage compartment;

a foam insulation filled in a first space formed between the outer case and the inner case;

a heat radiating member comprising at least one of a refrigerant pipe and a cord heater, and arranged in a second space formed between the outer case and the inner case; and a pressure member formed of a gas permeable film, the pressure member is configured to be deformed to press the heat radiating member based on a deformation condition, wherein under the deformation condition, the pressure member is provided to press the heat radiating member such that the heat radiating member is in contact with at least one wall of the second space, wherein the gas permeable film is configured to transmit gas and configured to block the foam insulation, wherein a through hole configured to allow the first space to communicate with the second space is formed in the inner case, and wherein the pressure member is provided to press the heat radiating member by being moved by the foam insulation that is introduced into the second space through the through hole and foams.

2. The refrigerator of claim 1, wherein under the deformation condition, when the heat radiating member is provided to come into contact with one wall of the second space, the heat radiating member is directed to a front side of the refrigerator, by the pressure member.

3. The refrigerator of claim 1, wherein:

the outer case comprises an end surface member configured to form one wall of the second space directed to a front side of the refrigerator, and the heat radiating member is provided to come into contact with the end surface member by the pressure member.

4. The refrigerator of claim 3, wherein:

the outer case further comprises a support portion configured to extend from the end surface member to be opened toward an inside of the storage compartment, and the inner case comprises a flange portion arranged between the end surface member and the support portion and configured to form the second space together with the end surface member and the support portion, the flange portion provided with a heat radiating member support portion configured to be opened toward the end surface member to support the heat radiating member.

5. The refrigerator of claim 4, wherein the pressure member is arranged between the heat radiating member support portion and the heat radiating member.

6. The refrigerator of claim 1, wherein the pressure member, which is deformed under the deformation condition, has a lower thermal conductivity than at least one of the outer case and the inner case.

7. The refrigerator of claim 1, wherein the deformation condition of the pressure member comprises applying a predetermined pressure, a predetermined acceleration or a predetermined vibration, or satisfying a predetermined pH, or making a predetermined chemical reaction.

8. The refrigerator of claim 1, wherein the heat radiating member comprises a refrigerant pipe formed for a refrigerant that flows at a higher temperature than an outside of the refrigerant pipe.

9. The refrigerator of claim 1, wherein the heat radiating member comprises a cord heater configured to generate heat by applying a current.

10. A refrigerator comprising:

a body;

a storage compartment arranged inside the body;

an insulating partition configured to partition the storage compartment;

a heat radiating member comprising at least one of a refrigerant pipe and a cord heater, and arranged inside the insulating partition; and a pressure member formed of a gas permeable film, and configured to be deformed to press the heat radiating member against a front side of the body, based on a deformation condition, wherein the gas permeable film is configured to transmit gas and configured to block a foam insulation, wherein a through hole configured to allow a first space of the insulating partition to communicate with a second space is formed in the insulating partition, and wherein the pressure member is provided to press the heat radiating member by being moved by the foam insulation that is introduced into the second space through the through hole and foams.

11. The refrigerator of claim 10, wherein under the deformation condition, the heat radiating member is provided to come into contact with one wall of the insulating partition, which is directed to a front side of the body, by the pressure member.

12. The refrigerator of claim 10, wherein:

the insulating partition comprises:

a first plate member and a second plate member;

an end surface member inserted into between the first plate member and the second plate member to be directed to a front side of the body; and a heat radiating member support portion arranged at a rear of the end surface member and configured to connect the first plate member to the second plate member, and the heat radiating member and the pressure member are arranged in a space formed by any one of the first plate member and the second plate member, the end surface member, and the heat radiating member support portion.

13. The refrigerator of claim 10, wherein the heat radiating member comprises a refrigerant pipe in which a high temperature refrigerant flows.

14. A refrigerator comprising:

an outer case;

an inner case arranged inside the outer case to define a storage compartment;

an insulating partition configured to partition the storage compartment;

a foam insulation filled in a first space formed between the outer case and the inner case, and filled in a second space formed in the insulating partition;

a heat radiating member comprising at least one of a refrigerant pipe and a cord heater, and arranged in at least one of the first space and the second space; and a pressure member formed of a gas permeable film, and configured to be deformed to press the heat radiating member based on a deformation condition, wherein under the deformation condition, the pressure member is provided to press the heat radiating member such that the heat radiating member is in contact with at least one of one wall of the first space and one wall of the second space, wherein the gas permeable film is configured to transmit gas and configured to block the foam insulation, wherein a through hole configured to allow the first space to communicate with the second space is formed in the inner case, and wherein the pressure member is provided to press the heat radiating member by being moved by the foam insulation that is introduced into the second space through the through hole and foams.

* * * * *